US009640340B2

(12) United States Patent
Zwirglmaier et al.

(10) Patent No.: US 9,640,340 B2
(45) Date of Patent: May 2, 2017

(54) SELECTOR SWITCH FOR TAP-CHANGING TRANSFORMERS AND SUPPORT ARM FOR A TAP SELECTOR THEREOF

(71) Applicant: Maschinenfabrik Reinhausen GmbH, Regensburg (DE)

(72) Inventors: Hurbert Zwirglmaier, Regensburg (DE); Silke Wrede, Zeitlarn (DE); Thomas Schuster, Regensburg (DE); Ulli Laubereau, Regensburg (DE); Gerhard Baeuml, Regenstauf (DE)

(73) Assignee: MASCHINENFABRIK REINHAUSEN GMBH, Regensburg (DE)

( * ) Notice: Subject to any disclaimer, the term of this patent is extended or adjusted under 35 U.S.C. 154(b) by 0 days.

(21) Appl. No.: 14/898,498

(22) PCT Filed: Jun. 24, 2014

(86) PCT No.: PCT/EP2014/063254

§ 371 (c)(1),
(2) Date: Dec. 15, 2015

(87) PCT Pub. No.: WO2015/007471

PCT Pub. Date: Jan. 22, 2015

(65) Prior Publication Data

US 2016/0133399 A1 May 12, 2016

(30) Foreign Application Priority Data

Jul. 16, 2013 (DE) ..... 10 2013 107 549

(51) Int. Cl.
*H01H 9/16* (2006.01)
*H01H 9/00* (2006.01)

(52) U.S. Cl.
CPC ..... *H01H 9/0027* (2013.01); *H01H 9/0016* (2013.01); *H01H 2009/0022* (2013.01)

(58) Field of Classification Search
CPC ..... H01H 9/0016; H01H 2009/0022; H01H 9/0027; H01H 9/0044; H01H 9/0038;
(Continued)

(56) References Cited

U.S. PATENT DOCUMENTS 2,217,595 A * 10/1940 Morgan ..... H05B 3/82 219/510
2,513,918 A * 7/1950 Coggeshall ..... H01H 33/165 218/115

(Continued)

FOREIGN PATENT DOCUMENTS

DE 4231353 A 4/1993
DE 10055406 B 4/2002

(Continued)

*Primary Examiner* — Edwin A. Leon
(74) *Attorney, Agent, or Firm* — Andrew Wilford

(57) ABSTRACT

A load selector for tapped transformers has an oil tank and a preselector having a first preselector contact and a second preselector contact for each phase to be switched by the load selector. The first preselector contact and the second preselector contact are mounted on a wall of the oil tank and extending through the wall of the oil tank. A first zero contact and a second zero contact separate from the first zero contact are provided for each phase to be switched by the preselector. The first zero contact and the second zero contact are each mounted on the wall of the oil tank and extend through the wall of the oil tank.

12 Claims, 5 Drawing Sheets

(58) Field of Classification Search
CPC ..... H01H 3/3052; H01H 9/0033; H01H 3/44; H01H 3/40; F16H 19/02; Y10T 74/18792; H02K 11/0042; H02K 7/1166; H02K 7/1004
USPC ..... 200/11 TC, 571, 275, 61.54, 504, 11 G; 218/147; 333/107, 262; 338/215; 336/127, 65, 137, 146–150, 141, 142; 322/71; 323/255, 256, 341, 342, 355–359
See application file for complete search history.

(56) References Cited

U.S. PATENT DOCUMENTS

| | | | | |
|---|---|---|---|---|
| 5,107,200 | A | 4/1992 | Dohnal | |
| 5,834,717 | A | 11/1998 | Neumeyer | |
| 7,977,589 | B2 * | 7/2011 | Lunn | H01H 9/0016 200/11 TC |
| 8,013,263 | B2 * | 9/2011 | Lindsey | H01H 9/0044 200/11 TC |
| 8,153,916 | B2 * | 4/2012 | Lindsey | H01H 9/0044 200/11 TC |

FOREIGN PATENT DOCUMENTS

| | | | |
|---|---|---|---|
| DE | 102007004530 | A | 9/2007 |
| DE | 202011109824 | U | 5/2012 |
| GB | 2049287 | A | 12/1980 |
| WO | 2012003864 | A | 1/2012 |

* cited by examiner

SELECTOR SWITCH FOR TAP-CHANGING TRANSFORMERS AND SUPPORT ARM FOR A TAP SELECTOR THEREOF

CROSS REFERENCE TO RELATED APPLICATIONS

This application is the US-national stage of PCT application PCT/EP2014/063254 filed 24 Jun. 2014 and claiming the priority of German patent application 102013107549.5 itself filed 16 Jul. 2013.

FIELD OF THE INVENTION

The present invention relates to a load selector for tapped transformers, particularly a load selector with a preselector arranged in an oil tank of the load selector. The preselector comprises a first preselector contact and a second preselector contact for each phase to be switched by the load selector. The first preselector contact and the second preselector contact are mounted on a wall of the oil tank and extend through the wall of the oil tank.

BACKGROUND OF THE INVENTION

In addition, the invention relates to a support arm for a preselector of a load selector. The support arm comprises a mounting section and has a free end formed opposite the mounting section. A fastening position for a contact bridge of the preselector is provided at the free end.

On-load tap changers (in abbreviation OLTC) are generally known and conventional in the prior art. They serve for uninterrupted switching over between different winding taps of tapped transformers.

Such on-load tap changers are divided into load selectors and load changeover switches.

In a load changeover switch with a selector, such as disclosed in, for example, German Patent Specification DE 100 55 406, the selector—consisting of a fine selector and possibly a preselector—is arranged below the load changeover switch. The selector serves for power-free selection of the respective new winding tap of the tapped transformer that is to be switched over to. The load changeover switch serves for the subsequent rapid and uninterrupted switching over from the connected winding tap to the new, preselected winding tap to be switched over to.

Load selectors such as described in, for example, German Patent Specification DE 28 33 126 similarly serve, like the load changeover switch with selector, for the purpose of switching over the taps of the regulating windings of these tapped transformers under load and thus selectively compensate for voltage changes at the user. Through dispensing with the separation of the load changeover switch from the selector, load selectors can be produced more economically.

Both kinds of on-load tap changer are actuated by a motor drive for the switching over. A drive output or drive input shaft that loads a force-storing unit is moved by the motor drive. When the force-storing unit is completely loaded, i.e. stressed, it is unlatched, abruptly releases its energy and actuates, in the space of milliseconds (ms), a switching tube that then executes a specific switching sequence during the load changeover. In that case, different switch contacts and resistance contacts are then actuated in a specific time sequence. The switching contacts serve for direct connection of the respective winding tap with the load diverter and the resistance contacts for temporary connection, i.e. bridging-over by means of one or more switching-over resistances.

Advantageously, vacuum interrupters are used as switching elements for the load changeover. This is based on the fact that the use of vacuum interrupters for load changeover prevents formation of arcs in the oil and thus oil contamination of the load changeover switch oil, as described in, for example, German Patent Specifications DE 195 10 809 [U.S. Pat. No. 5,834,717] and DE 40 11 019 [5,107,200] and German published specifications DE 42 31 353 A1 and DE 10 2007 004 530 A1.

German published specification DE 29 13 271 [GB 2,049, 287] describes a three-phase load selector for tapped transformers. Stationary preselector contacts are mounted on an inner wall of the oil tank of the load selector. The stationary preselector contacts cooperate with preselector contact bridges that are movable relative to the oil tank and that are mounted on an insulating material part that is disposed in the interior of the oil tank and capable of limited rotation relative to the tank.

International Application PCT/EP2010/059678, published as WO 2012/003864, relates to a preselector in a tap changer. A contact support comprises at least one movable contact that cooperates with preselector contacts mounted on a surrounding cylinder. In that case, the contact support is rotatable relative to the cylinder so that, through a rotation, the movable contact can come into electrically conductive connection with different preselector contacts. The course of the angular speed of the rotational movement is in that case varied during a switching process in order to reduce arc formation when a switching process takes place.

Contact supports, which are formed similarly to the basic concept, for preselectors are also described in Applications CN 2006101116522 and CN 200610116524. A further example is also present in CN 102623201.

An arc can arise in a preselector in switching processes when contact interruption takes place. In the case of repeated switching processes in the course of the service life of the preselector this can lead to damage of the contacts and to contamination of the oil in which the preselector together with further components of the load selector are located.

In order to avoid arc formation, on the one hand the switching-over speed can be increased, which means additional demands on the drive of the preselector. On the other hand, resistances can be temporarily interposed so as to lead to a voltage reduction and thus prevention of or at least reduction in arc formation at the contact to be separated. Such resistances need room, i.e. they demand additional constructional space. Moreover, resistances lead to additional costs. In addition, the resistances are additional components that can have susceptibilities to fault and thus increase the susceptibility of the entire arrangement to fault.

OBJECT OF THE INVENTION

It is therefore an object of the invention to provide a load selector in which arc formation during switching processes in the preselector is reduced even without interposition of resistances.

A further object of the invention is to provide a support arm for a preselector of a load selector that fulfils electrostatic and mechanical requirements, but is nevertheless economic and simple to produce.

SUMMARY OF THE INVENTION

The load selector according to the invention comprises an oil tank and a preselector. Apart from electrical terminal elements for the preselector, which are provided in the wall of the oil tank and are accessible from outside the oil tank, the preselector is disposed in the interior of the oil tank. Drive of the preselector takes place as known from the prior art; suitable drive devices can be provided, for example, on a cover of the oil tank.

The preselector of the load selector according to the invention has for each phase to be switched by the load selector a first preselector contact and a second preselector contact. The first and second preselector contacts belong to the electrical terminal elements, which were already mentioned above, for the preselector and are mounted on the wall of the oil tank. In that case, the first and second preselector contacts extend through the wall of the oil tank, i.e. they represent an electrically conductive connection between an interior space of the oil tank and the exterior space, thus the environment of the oil tank of the load selector. The first and second preselector contacts are electrically insulated relative to the wall of the oil tank.

Known preselectors additionally have a zero contact for each phase to be switched by the preselector. In the case of the load selector according to the invention the preselector has, in particular, a first zero contact and a second zero contact for each phase to be switched by the load selector. According to the invention the first zero contact and the second zero contact are constructed as separate elements. The first zero contact and the second zero contact are respectively mounted on the wall of the oil tank and extend through the wall of the oil tank, i.e. they represent an electrically conductive connection between the interior space of the oil tank and the exterior space, thus the environment of the oil tank of the load selector. The first and second zero contacts are electrically insulated relative to the wall of the oil tank. In operation of the load selector the zero contacts are at a reference potential for the load selector. The reference potential is also termed zero potential or ground potential.

The preselector of the load selector according to the invention has a first switching state and a second switching state. In the first switching state of the preselector an electrically conductive connection is provided within the oil tank between the first preselector contact and the first zero contact. In the second switching state of the preselector an electrically conductive connection is provided within the oil tank between the second preselector contact and the second zero contact. The regulating range of the transformer is extended by a change in the switching state of the preselector.

The advantage of use of a first and a second zero contact, thus two separate zero contacts, is that in the case of a switching process, thus a transition from the first to the second switching state of the preselector or vice versa, not only the electrical contact with the corresponding preselector contacts is interrupted, but also the electrical contact with the corresponding zero contacts is interrupted. As a result, creation or maintenance of an arc is hampered, i.e. considered overall the formation of arcs during switching processes of the preselector is reduced.

In one form of embodiment, for at least one phase to be switched by the load selector the first zero contact and the second zero contact are electrically conductively connected outside the oil tank by a connecting element. The previously explained advantages of use of separate zero contacts are not cancelled by the stated conductive connection between zero contacts outside the oil tank. Due to the electrically conductive connecting element between the zero contacts for a phase, however, a common electrical line suffices for the zero contacts belonging to a phase.

In one form of embodiment of the load selector according to the invention the preselector comprises a contact support that is arranged in the interior of the oil tank. The contact support is a component having an electrically conductive contact bridge for each phase to be switched by the load selector. The contact support is rotatable relative to the oil tank between a first contact setting and a second contact setting; the drive for that can, as mentioned above, be effected by known measures. If the contact support is in the first contact setting, the first switching state of the preselector is provided. If the contact support is in the second contact setting, the second switching state of the preselector is provided.

The first and second contact settings are in that case characterized as follows:

In the first contact setting of the contact support, for each phase to be switched by the load selector a first end of the respective contact bridge is in electrically conductive connection with the respective first preselector contact and a second end of the respective contact bridge contacts the respective first zero contact. An electrically conductive connection between the first preselector contact and the first zero contact is thereby provided within the oil tank.

In the second contact setting of the contact support, for each phase to be switched by the load selector the first end of the respective contact bridge is in electrically conductive connection with the respective second preselector contact and the second end of the respective contact bridge contacts the respective second zero contact. An electrically conductive connection between the second preselector contact and the second zero contact is thereby provided within the oil tank.

The advantage, which was already discussed above, of use of two zero contacts in this form of embodiment manifests itself as follows: In a switching process of the preselector, through rotation of a contact support not only the first ends of the contact bridges lose contact with the corresponding preselector contacts, but also the second ends of the contact bridges lose contact with the corresponding zero contacts. As a result, creation or maintenance of an arc is hampered, i.e. considered overall the formation of arcs in switching processes of the preselector is reduced.

In a further form of embodiment of the load selector according to the invention the contact support comprises a support ring at which as many support arms as provided as there are phases to be switched by the load selector. Each support arm carries at its end opposite the support ring one of the contact bridges of the preselector.

In a development of this form of embodiment, the contact bridges are in that case arranged along the circumference of a circle. The diameter of this circle is, in the case of the form of embodiment illustrated here, greater than the outer diameter of the support ring. This arrangement on the one hand utilizes the inner diameter of the oil tank in order to achieve a largest possible spacing between the contact bridges for the individual phases, but demands less space in the region of the support ring that has the consequence of advantages for the installation of the contact support and the overall preselector in the load selector.

The support arm according to the invention of the preselector of a load selector has a mounting section by which it is mounted on the support ring of the preselector. Opposite the mounting section the support arm has a free end at which a fastening position for a contact bridge is provided. The support arm is produced in such a way in one working step that it is formed with a first and a second lateral rib and, between the first and second lateral ribs, at least one web-like elevation extending along the length of the support arm.

In particular, the fastening position for the contact bridge can be formed by the web-like elevation at the free end of the support arm. In addition, first and second lateral mounts for the contact bridge are formed at the free end of the support arm. The support arm is preferably formed with a plurality of area elements that are arranged at an angle relative to one another and that extend from the mounting section toward the free end of the support arm.

The support arm is preferably produced together with the plurality of area elements arranged at an angle relative to one another (wave-shaped arrangement of the area elements), the first lateral rib, the second lateral rib, the web-like elevation, the fastening position, the first lateral mount and the second lateral mount from an electrically nonconductive material by means of a shaping process, preferably by an injection-molding process. The electrically nonconductive material is preferably a plastics material that can in addition be provided with a filler for improvement of the mechanical characteristics.

The advantage of this embodiment of the support arms of the preselector is prolongation of the electrical creep path and at the same time increase in the mechanical strength of the respective support arm.

The load selector according to the invention is advantageously usable for single-phase and multi-phase alternating voltage mains. In particular, the load selector can be designed to switch three phases.

BRIEF DESCRIPTION OF THE DRAWING

The invention and advantages thereof are described in more detail in the following with reference to the accompanying drawings in which.

SPECIFIC DESCRIPTION OF THE INVENTION

Figure 1:
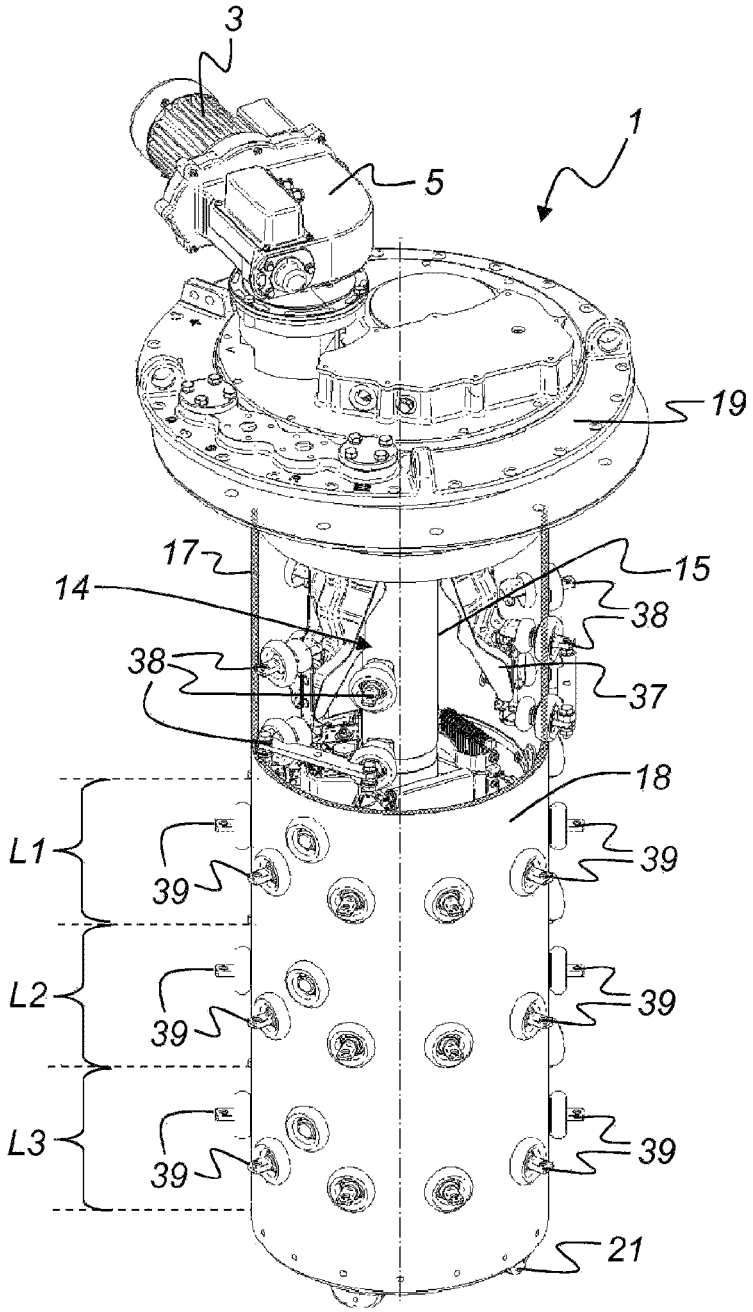
FIG. 1 is a perspective view of a form of embodiment of the load selector according to the invention with three phases.

Identical reference numerals are used for the same or equivalent elements of the invention. In addition, for the sake of clarity only reference numerals required for description of the respective FIG. are illustrated in the individual figures. The illustrated forms of embodiment merely represent examples of how the load selector according to the invention and the support arm according to the invention can be designed and thus do not represent a definitive limitation of the invention. In particular, it is to be noted that even through the FIGS. and the description thereof refer to a three-phase load selector, the invention is directed to a load selector for single-phase or multi-phase current mains so that the trinity of the phases does not represent a limitation of the invention.

FIG. 1 shows a perspective view of a form of embodiment of the on-load tap changer or load selector 1 according to the invention with three phases L1, L2 and L3. The load selector 1 comprises a drive 3 such as, for example, an electric motor, with a transmission 5 that loads a force-storing unit (not illustrated). When the force-storing unit is completely loaded, i.e. stressed, it is unlatched, abruptly releases its energy and actuates a switching tube 15 of a load change-over switch insert 14. The rotating or pivoting switching tube 15 is in that case mounted in an oil tank 18. The oil tank 18 is closed toward the top by a cover 19 and in addition carries a base 21.

The load selector 1 according to the invention is multi-phase and has, for example, a first phase L1, a second phase L2 and a third phase L3 that are arranged one above the other in the oil tank 18. A preselector 37 is seated above the three phases L1, L2, L3. In the view illustrated here, electrical terminal elements 38 for preselector contacts 71, 72 (see FIG. 2) are provided at the oil tank wall 17 of the oil tank 18. Electrical terminal elements 39 for tap contacts (not illustrated) of the three phases L1, L2, L3 are similarly so mounted on the load selector 1 that they pass through the oil tank wall 17 of the oil tank 18.

Figure 2:
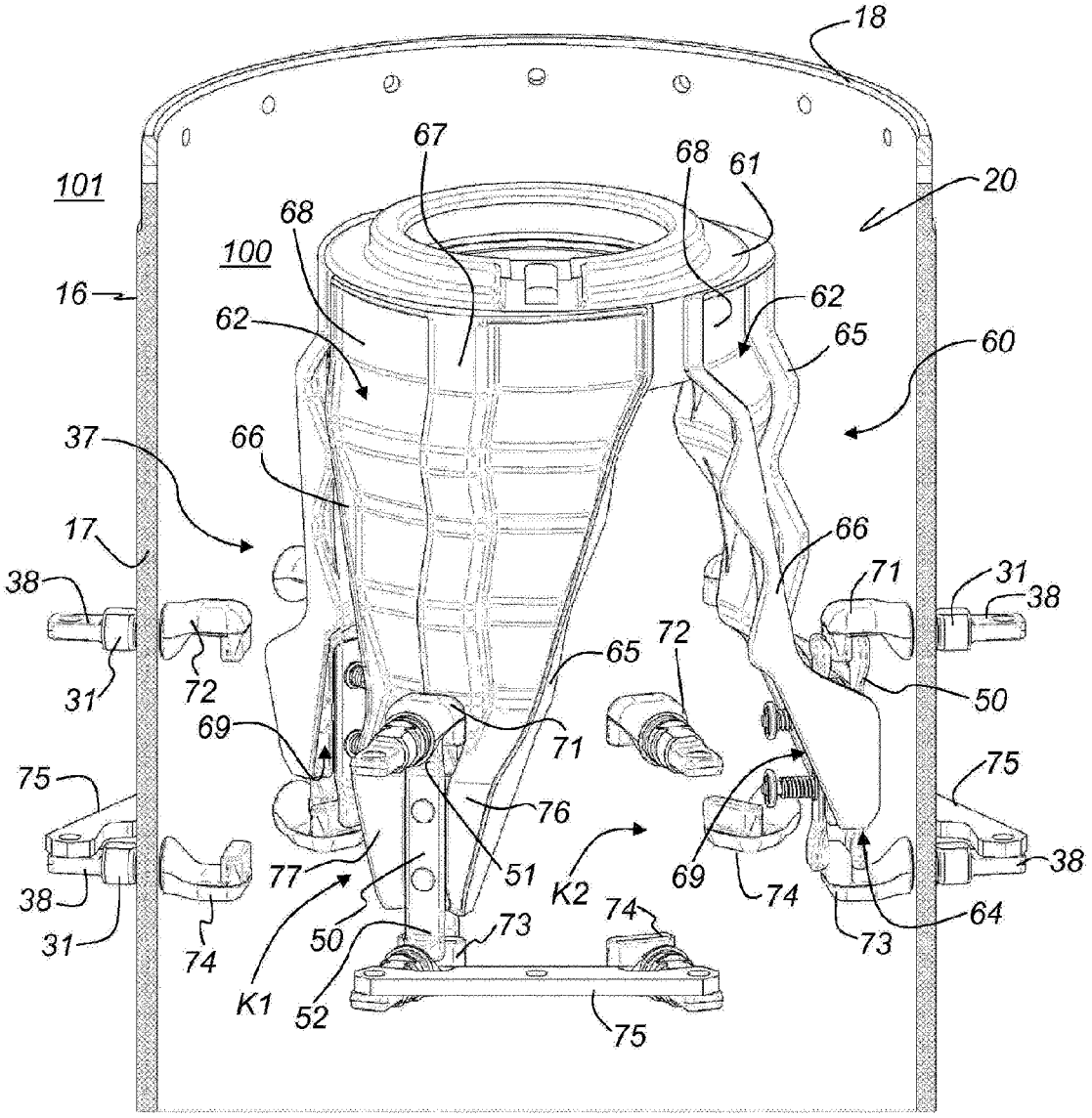
FIG. 2 is a perspective view of the preselector of the load selector according to FIG. 1.

FIG. 2 shows the preselector 37 within the oil tank 18. The preselector 37 comprises a contact support 60 that comprises a support ring 61 and support arms 62 mounted on the support ring 61. Since the illustration shows a preselector 37 for a three-phase load selector 1 (see FIG. 1), three support arms 62 of an electrically insulating material are accordingly provided in this form of embodiment. Thus, a respective support arm 62 is provided per phase L1, L2, L3 (see FIG. 1), which phases are switched by the load selector 1 by means of a pivot movement and a pivot movement, which is connected therewith, of the support arms. A contact bridge 50 is mounted on each support arm 62 at the free end 64 of the support arm 62.

First preselector contacts 71 and second preselector contacts 72 as well as first zero contacts 73 and second zero contacts 74 are mounted on an inner wall 20 of the oil tank 18. The first preselector contacts 71, the second preselector contacts 72, the first zero contacts 73 and the second zero contacts 74 are mounted on the inner wall 20 of the oil tank 18. The first preselector contacts 71, the second preselector contacts 72, the first zero contacts 73 and the second zero contacts 74 pass through the all tank wall 17 by way of a respective electrical terminal element 38 to the outer wall 16 of the oil tank 18. The electrical terminal elements 38 of the first preselector contacts 71, the second preselector contacts 72, the first zero contacts 73 and the second zero contacts 74 are each so mounted in the oil tank wall 17 by way of a respective mounting element 31 that they are securely and permanently positioned during operation of the preselector 37. The first preselector contacts 71, second preselector contact 72, first zero contact 73 and second zero contact 74 are provided respectively for each phase L1, L2, L3 to be switched by the load selector 1. Due to the illustration some of these contacts are covered by other elements. The first preselector contacts 71, second preselector contacts 72, first zero contacts 73 and second zero contacts 74 extend through the wall 17 of the oil tank 18 and thus represent a conductive connection between an interior space 100 of the oil tank 18 and an environment 101 of the oil tank. The first zero contacts 73, second zero contacts 74, first preselector contacts 71 and second preselector contacts 72 are electrically insulated from one another by the wall 17 of the oil tank 18.

In the form of embodiment shown here, in each instance the first zero contact 73 and the second zero contact 74 that belong to a phase L1, L2, L3 to be switched by the load selector 1, are connected by a respective electrically conductive connecting element 75. This connecting element 75 in each case respectively lies outside the oil tank 18.

In the depicted illustration, the preselector 37 is in a first contact setting K1. In that case, for each phase L1, L2, L3 a first end 51 of the respective contact bridge 50 is in electrically conductive connection with the respective first preselector contact 71 and a second end 52 of the respective contact bridge 50 contacts the first zero contact 73 for the respective phase L1, L2, L3.

In a second contact setting K2, for each phase L1, L3, L3 the first end 51 of the respective contact bridge 50 would be in electrically conductive connection with the respective second preselector contact 72 and the second end 52 of the respective contact bridge 50 would contact the second zero contact 74 for the respective phase L1, L2, L3.

Figure 3:
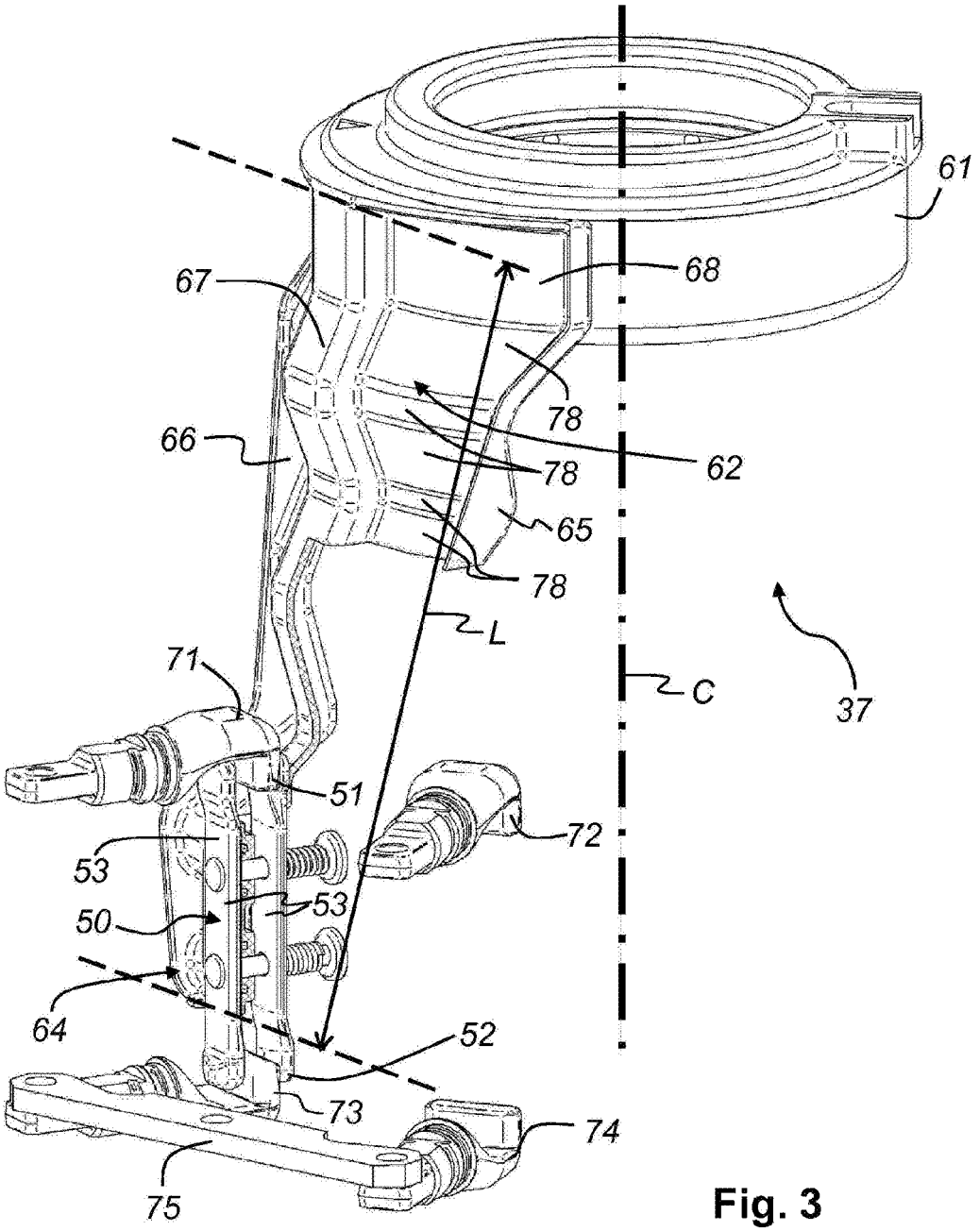
FIG. 3 is a detail view of the preselector of FIG. 2.

Transitions between the first contact setting K1 and the second contact setting K2 of the preselector 37 take place through a rotational movement of the preselector 37 about an axis C (see FIG. 3).

FIG. 3 shows a detail view of the preselector 37 of FIG. 2. The predominant number of illustrated elements was already discussed in FIG. 2. The specific form of the first preselector contacts 71, second preselector contacts 72, first zero contacts 73 and second zero contacts 74 is not to be interpreted as a limitation of the invention. Representing a limitation of the invention even less is the fact that the contact bridge 50 in the illustrated form of embodiment comprises two parallel electrically conductive metal strips 53 engaging between the preselector contacts 71, 72 and zero contacts 73, 74 in order to produce an electrical contact. It is only relevant in this regard that the contact bridge 50 can produce an electrically conductive connection between the first preselector contact 71 and the first zero contact 73 or between the second preselector contact 72 and the second zero contact 74 for each contact setting K1, K2 of the preselector 37. The transition between the first contact setting K1 and the second contact setting K2 and conversely takes place by a pivot movement of the preselector 37 about the axis C.

The illustrations of FIGS. 2 and 3 also show a design of the support arm 62 of the preselector 37 in accordance with the invention. The support arms 62 are shaped in such a way that they can be produced from a nonconductive material, preferably plastics material, by means of a shaping process, for example an injection-molding method. In order to be able to save material for the production of the support arm 62 and yet achieve the mechanical stability required for operation, a first lateral rib 65 and a second lateral rib 66 are formed at the support arm 62. In addition, at least one web-like elevation 67 extending along the length L of the support arm 62 is formed between the first lateral rib 65 and the second later rib 66. The support arm 62 is fastened to the support ring 61 by a mounting section 68. The support arm 62 has a free end 64 opposite the mounting section 68. The free end 64 has a fastening position 69 for a contact bridge 50. The fastening position 69 for the contact bridge 50 is formed by the web-like elevation 67, wherein in addition a first lateral mount 76 and a second lateral mount 77 for the contact bridge 50 are formed at the free end 64 of the support arm 62.

The fastening position 69, first lateral mount 76 and second lateral mount 77 for the contact bridge 50 are formed in one working step during the production process, such as, for example, injection molding, for the support arm 62. During production of the support arm 62, several area elements 78 that extend from the mounting section 68 to the free end 64 of the support arm 62, are formed in the support arm 62. The area elements 78 are respectively arranged at an angle relative to one another. Through this arrangement of the area elements 78 in accordance with the invention there is achieved on the one hand a mechanical stability of the support arm 62 and on the other hand a sufficient effective length of the support arm 62 in order to maintain the requisite insulating distance. The first lateral rib 65, the second lateral rib 66, the web-like elevation 67 and the plurality of areal elements 78 together have a wave-shaped form along the length L of the support arm 62 whereby the creep path is prolonged.

Figure 4:
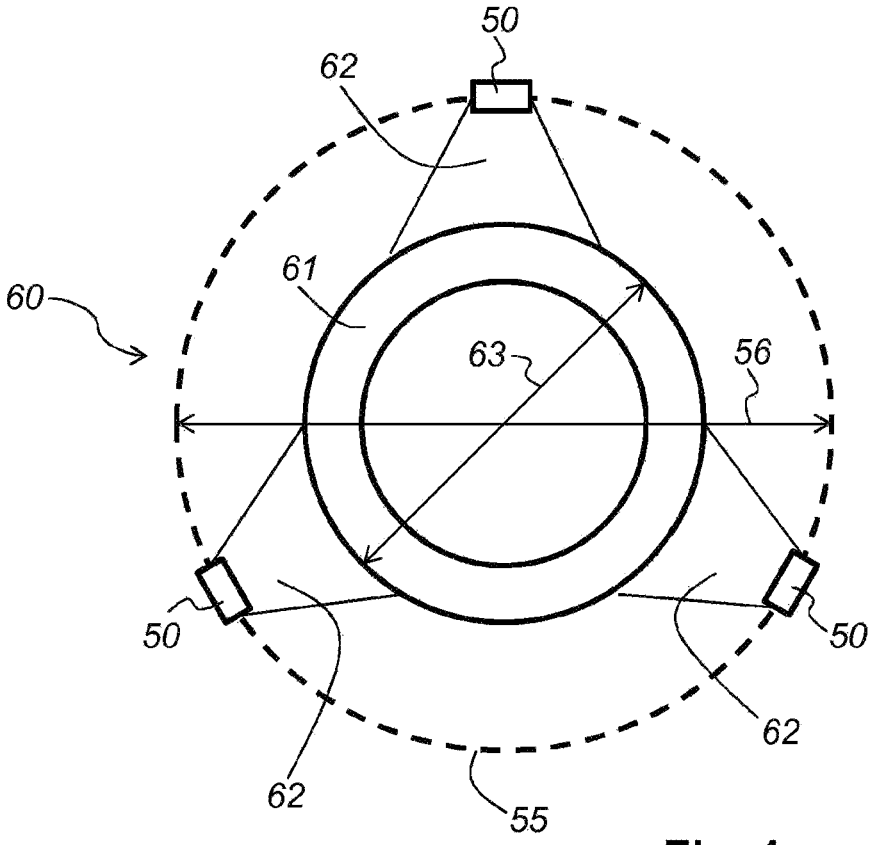
FIG. 4 is a schematic plan view of the contact support of the load selector according to FIG. 1.

FIG. 4 shows a schematic plan view of a possible form of embodiment of the contact support 60. In that case, only the support ring 61, support arms 62 and contact bridges 50 respectively arranged thereon are shown. The contact bridges 50 here lie on a circle 55, the diameter 56 of which is larger than the outer diameter 63 of the support ring 61. The advantages resulting therefrom were already explained further above. The difference between the diameter 56 of the circle 55 and the outer diameter 63 of the support ring 61 is achieved by the fact that each support arm 62 includes an angle greater than zero with the axis C of the preselector 37 (see FIG. 3).

Figure 5:
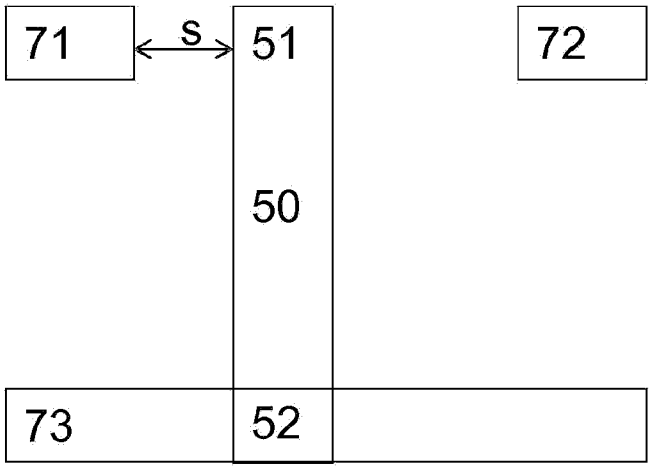
Prior Art Fig. 5
FIG. 5 is a schematic illustration according to the prior art for the connecting of the preselector contacts.

A schematic illustration according to the prior art for the connecting of the preselector contacts 71, 72 is illustrated in FIG. 5. Here, through the contact bridge 50 by the first end 51 and the second end 52 always only one interruption is possible when the first preselector contact 71 and the first zero contact 73 are separated from one another. An opening path S is present only between the first preselector contact 71 and the first end 51 of the contact bridge 50.

Figure 6:
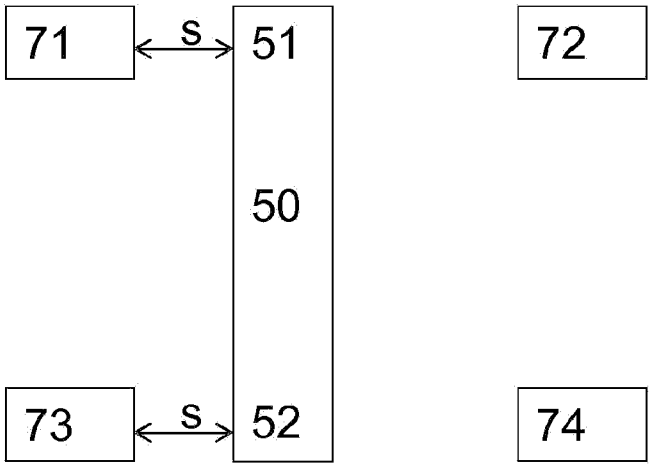
FIG. 6 is a schematic illustration according to the invention for the connecting of the preselector contacts.

A schematic illustration according to the invention for the connecting of the preselector contacts 71, 72 is illustrated in FIG. 6. The double interruption makes possible, for the same speed of the contact bridge 50, an electrically effective opening speed that is doubled. An opening path S between the first preselector contact 71 and the first end 51 of the contact bridge 50 and a further opening path S between the first zero contact 73 and the second end 52 of the contact bridge 50 arise at the same time. As a result, the amount of gas created during production of the contact is significantly reduced. In addition, the achievable switching performance is significantly increased for the same diameter of the load selector 1. Use of resistances for an increased spectrum of use is thereby completely avoided. This in turn has the consequence, in the increased spectrum of use, of avoidance of the otherwise usual impedance losses due to resistances.

The invention claimed is:

1. A load selector for tapped transformers, the load selector comprising:

an oil tank;

a preselector having a first preselector contact and a second preselector contact for each phase to be switched by the load selector, the first preselector contact and the second preselector contact being mounted on a wall of the oil tank and extending through the wall of the oil tank; and a first zero contact and a second zero contact separate from the first zero contact for each phase to be switched by the preselector, the first zero contact and the second zero contact each being mounted on the wall of the oil tank and extending through the wall of the oil tank.

2. The load selector according to claim 1, wherein, for at least one phase to be switched by the load selector, the first zero contact and the second zero contact are electrically conductively connected outside the oil tank by a respective connecting element.

3. The load selector according to claim 1, wherein, in a first switching state of the preselector, an electrically conductive connection is provided within the oil tank between the first preselector contact and the first zero contact and, in a second switching state of the preselector, an electrically conductive connection is provided within the oil tank between the second preselector contact and the second zero contact.

4. The load selector according to claim 3, wherein the preselector comprises a contact support inside the oil tank and having a respective electrically conductive contact bridge for each phase to be switched by the load selector and rotatable relative to the oil tank between a first contact setting and a second contact setting, in the first contact setting of the contact support corresponding to the first switching state of the preselector and for each phase to be switched by the load selector a first end of the respective contact bridge is in electrically conductive connection with the respective first preselector contact and a second end of the contact bridge contacts the respective first zero contact, and in a second contact setting of the contact support corresponding to the second switching state of the preselector and the first end of the respective contact bridge is in electrically conductive connection with the respective second preselector contact and the second end of the contact bridge contacts the respective second zero contact.

5. The load selector according to claim 4, wherein the contact support comprises a support ring having as many support arms as phases to be switched by the load selector and a respective one of the contact bridges is mounted on an end of each support arm opposite the support ring.

6. The load selector according to claim 5, wherein the contact bridges are arranged along the circumference of a circle having a diameter greater than an outer diameter of the support ring.

7. The load selector according to claim 1 wherein the load selector has three phases.

8. A support arm of a preselector of a load selector having:

a mounting section; and a free end formed opposite the mounting section and forming a fastening position for a contact bridge;

a first lateral rib formed on the support arm;

a second lateral rib also formed on the support arm; and at least one web-like elevation between the first lateral rib and the second lateral rib and extending along a full length of the support arm.

9. The support arm according to claim 8, wherein the fastening position for the contact bridge is formed by the web-like elevation at the free end of the support arm and a first lateral mount and a second lateral mount for the contact bridge are formed at the free end of the support arm.

10. The support arm according to claim 8, wherein the support arm is formed with a plurality of area elements that are each arranged at an angle relative to one another and that extend from the mounting section toward the free end of the support arm.

11. The support arm according to any claim 10, wherein the support arm together with the plurality of area elements, the first lateral rib, the second lateral rib, the web-like elevation, the fastening position, the first lateral mount and the second lateral mount are injection-molded from an electrically nonconductive material.

12. The support arm according to claim 11, wherein the electrically nonconductive material is a plastic.

* * * * *